United States Patent [19]

Su

[11] Patent Number: 5,048,550

[45] Date of Patent: Sep. 17, 1991

[54] STRUCTURE OF TRIPLE-FOLDING UMBRELLA SKELETON

[75] Inventor: Peter Su, Hsinchu, Taiwan

[73] Assignee: Befashion Umbrella Co., Ltd., Taiwan

[21] Appl. No.: 547,259

[22] Filed: Jul. 3, 1990

[51] Int. Cl.[5] ..... A45B 19/00

[52] U.S. Cl. ..... 135/25 R

[58] Field of Search ..... 135/25 R, 25 A, 22, 135/23

[56] References Cited

U.S. PATENT DOCUMENTS

| | | | |
|---|---|---|---|
| 21,313 | 8/1858 | Boernicke | 135/25 R |
| 974,643 | 11/1910 | Carlson | 135/25 R |
| 2,616,439 | 11/1952 | Thompson | 135/25 R |
| 2,711,183 | 6/1955 | Kiel | 135/25 R |
| 3,457,931 | 7/1969 | Shimuzu | 135/25 R |
| 3,802,452 | 4/1974 | Weber | 135/25 R |
| 3,902,514 | 9/1975 | Weber | 135/25 R |
| 4,030,515 | 1/1977 | Weber | 135/25 R |

FOREIGN PATENT DOCUMENTS

| | | | |
|---|---|---|---|
| 2422209 | 4/1974 | Fed. Rep. of Germany | 135/25 R |
| 2353352 | 5/1974 | Fed. Rep. of Germany | 135/25 R |
| 2510473 | 9/1976 | Fed. Rep. of Germany | 135/25 R |

*Primary Examiner*—Henry E. Raduazo

*Attorney, Agent, or Firm*—Lowe, Price, LeBlanc and Becker

[57] ABSTRACT

A triple-folding umbrella skeleton includes a plurality sets of frame arranged around the middle tube and pivotably mounted on the notch and runner respectively. Each frame set includes a first rib, a second rib, a third rib, a stretcher and a first link. One end of the first rib is pivotably mounted on the runner. The two ends of the second rib is pivotably mounted to the other end of the first rib and one end of the third rib respectively. One end of the stretcher is pivotably mounted on the notch, and other end of the stretcher is pivotably mounted to the first rib. The first link is generally parallel to the first rib, and its two ends is pivotably mounted to a first extension portion of the second rib and the stretcher respectively. The first link, the stretcher, the first rib and the first extension portion cooperate to form a quadric link structure. The triple-forming umbrella skeleton is characterized in that each frame set further includes a connecting spring and a second link generally parallel to the second rib. One end of the second link is pivotably mounted to a second extension portion of the third rib, and the other end of the second link is connected to the first rib via the connecting spring. Whereby, each frame set can be expanded to a largest extent to obtain a largest canopy shielding area, and only a smaller force is needed to open the triple-folding umbrella skeleton, due to the retractability of the connecting spring.

1 Claim, 7 Drawing Sheets

STRUCTURE OF TRIPLE-FOLDING UMBRELLA SKELETON

BACKGROUND OF THE INVENTION

The present invention relates to an improved structure of triple-folding umbrella skeleton.

In FIGS. 2A, 2B, 2C, 3A, and 3B, two kinds of prior triple-folding umbrella skeletons are shown. FIG. 2A is a front elevational view of partial structure of one conventional triple-folding umbrella skeleton. FIG. 2B is an enlarged perspective view of the circular area marked "Z" in FIG. 2A. FIG. 2C is a side elevational view of the part shown in FIG. 2B. FIG. 3A is a front elevational view of partial structure of another conventional triple-folding umbrella skeleton. FIG. 3B shows that the umbrella skeleton of FIG. 3A is in a wholly open condition.

The conventional triple-folding umbrella skeleton, as shown in FIG. 2A, includes a hollow middle tube 7 and a plurality sets of frames mounted around the middle tube 7. For convenient illustrated, only one frame set is shown in FIG. 2A. Each frame set includes a first rib 1, a second rib 2, a third rib 3, a stretcher 4, and a link 5. A notch 71 is mounted at the upper portion of the middle tube 7. A runner 72 is slidably sleeved on the intermediate portion of the middle tube 7. An upper spring 73 is mounted in the middle tube 7, and has a part extending out of the surface of the middle tube 7 to lock the runner 72 at an upper position. One end of each first rib 1 is pivotably mounted on the runner 72, and the other end of the first rib 1 is pivotably mounted to one end of the second rib 2 via an eyelet 12. The other end of the second rib 2 is pivotably mounted to one end of the third rib 3 via an eyelet 23. One end of the stretcher 4 is pivotably mounted on the notch 71, and the other end of the stretcher 4 is pivotably mounted to the middle portion of the first rib 1. The second rib 2 further has an extension portion 20 longitudinally extending outwards from the eyelet 12. The link 5 is generally parallel to the first rib 1, and its two ends are pivotably mounted to the free end of the extension portion 20 and the stretcher 4 respecttively. FIG. 2B is an enlarged perspective view of the eyelet 23 (the circular area "Z" indicated in FIG. 2A). FIG. 2C is a side elevational view of the eyelet 23 shown in FIG. 2B. In FIG. 2C, the solid line of the third rib 3 indicates its position when the umbrella is opened, while the dotted line of the third rib 3 indicates its position when the umbrella is closed. When opening the above-described umbrella skeleton, a user must first pivot each third rib 3, along the direction of the arrow A, from the dotted-line position shown in FIG. 2C to the solid-line position of FIG. 2C about the eyelet 23, before pushing the runner 72 upwards to open all of the frame sets. If he does not pivot the third ribs 3 to the solid-line position in advance, the third ribs 3 may maintain at the dotted-line position when the umbrella is opened. In this case, the third ribs 3 cannot function at all. When a user wants to close the umbrella skeleton, he must first move the runner 72 downwards to the position shown in FIG. 2A until all of the frame sets are retracted to a generally closed condition, and then pivot each third rib 3, along the direction of the arrow B, from the solid-line position of FIG. 2C to the dotted-line position in order to wholly close the umbrella skeleton. Therefore, it is time-consuming and inconvenient to open or close the above conventional umbrella. Particularly, when the user is caught in a shower and has to open the umbrella immediately, it often happens that some of the third ribs 3 cannot be smoothly opened right away. Simimarly, it is also very difficult to completely close the umbrella by a single operation without arranging the canopy of the umbrella with hands in advance. Hence, the above prior triple-folding umbrella has many drawbacks.

In view of the above-described drawbacks, another structure of triple-folding umbrella skeleton as shown in FIGS. 3A and 3B is suggested. In comparison with the umbrella skeleton of FIG. 2A, the umbrella skeleton of FIG. 3A further includes a second link 6. The second link 6 is generally parallel to the second rib 2, and its two ends are pivotably mounted to the first rib 1 and the free end of an extension portion 30 of the third rib 3. In this case, the second link 6, the first rib 1, the second rib 2 and the third rib 3 are cooperated to form a second quadric link structure. When the runner 72 is moved upwards along the direction of the arrow C shown in FIG. 3A, the eyelet G' of the third rib 3 at which the second link 6 is pivotably mounted is moved upwards, resulting in the outer expansion of the third rib 3 along the direction of the arrow E. Therefore, the provision of the second link 6 can make the third rib 3 opened automatically when the runner 72 is moved upwards, so that the problems of the umbrella skeleton shown in FIGS. 2A–2C are solved.

However, the umbrella skeleton of FIG. 3A still suffers from some drawbacks. When each frame set is opened to a nearly wholly open condition as shown in FIG. 3B, that is, when the second link 6 is substantially aligned with the third rib 3, the eyelet G' is located between the eyelets F' and N'. The second quadric link structure formed by the second link 6, the first, second and third ribs 1, 2 and 3 is deformed into a triangle having three tips at the eyelets M', N' and F', respectively. Under such condition, since slight deformation of each frame set and, in particular, of each second rib 2 is necessary to permit the complete opening of the umbrella, and since the deformability of the members forming the triangle is quite limited, the user has to exert a relatively large force to overcome the deformation resistance by the frame sets during umbrella opening operation. In addition, it is found in practical use of this prior triple-folding umbrella that, when the parallelogram M'P'Q'R' is being moved as the umbrella is being opened, its movement is greatly restrained by the nearly rigid second link 6 which is pivotably mounted at the point N' of the first rib 1. It is found in real operation that the sizes of the ribs and link forming the parallelogram M'P'Q'R' cannot be too small, or the expansion of the third rib 3 will be very difficult.

SUMMARY OF THE INVENTION

In order to solve the above problems, the present invention suggests an improved structure of triple-folding umbrella skeleton. When all of the frame sets of the present invention have been expanded to a nearly wholly expanded condition, only a relatively small force is further needed to urge the umbrella to the wholly expanded condition.

Another object of the present invention is to provide an improved structure of triple-folding umbrella skeleton which may obtain a larger canopy shielding area by utilizing shorter middle tubes and ribs.

In accordance with the present invention, a triple-folding umbrella skeleton comprising:

a middle tube;

a notch mounted on the upper portion of the middle tube;

a runner slidably sleeved to the intermediate portion of the middle tube, and capable of being locked to maintain the triple-folding umbrella skeleton in an open condition; and a plurality sets of frame pivotably mounted on the notch and runner respectively, each frame set including a first rib, a second rib, a third rib, a stetcher and a first link, one end of the first rib being pivotably mounted on the runner, the two ends of the second rib being pivotably mounted to the other end of the first rib and one end of the third rib respectively, one end of the stretcher being pivotably mounted on the notch, the other end of the stretcher being pivotably mounted to the approximately intermediate portion of the first rib, the first link being generally parallel to the first rib, the second rib having a first extension portion extending outwards from its end portion at which the first rib is mounted, and the two ends of the first link being pivotably mounted to the first entension portion and the stretcher respectively, so that the first link, the stretcher, the first rib and the first extension portion of the second rib cooperate to form a quadric link structure;

the triple-folding umbrella skeleton being characterized in that:

each frame set further includes a connecting spring and a second link generally parallel to the second rib, the third rib has a second extension portion extending outwards from its end portion at which the second rib is mounted, one end of the second link is pivotably mounted to the second extension portion, and the other end of the second link is connected to the first rib via the connecting spring, whereby each frame set can be expanded to a largest extent to increase the shielding area of the canopy, and only a smaller force is needed to completely open the triple-folding umbrella skeleton, due to the retractability of the connecting spring.

BRIEF DESCRIPTION OF THE DRAWINGS

The present invention can be more fully understood by reference to the following description and accompanying drawings, which form an integral part of this application.

DETAILED DESCRIPTION OF THE PREFERRED EMBODIMENTS

Figure 1A:
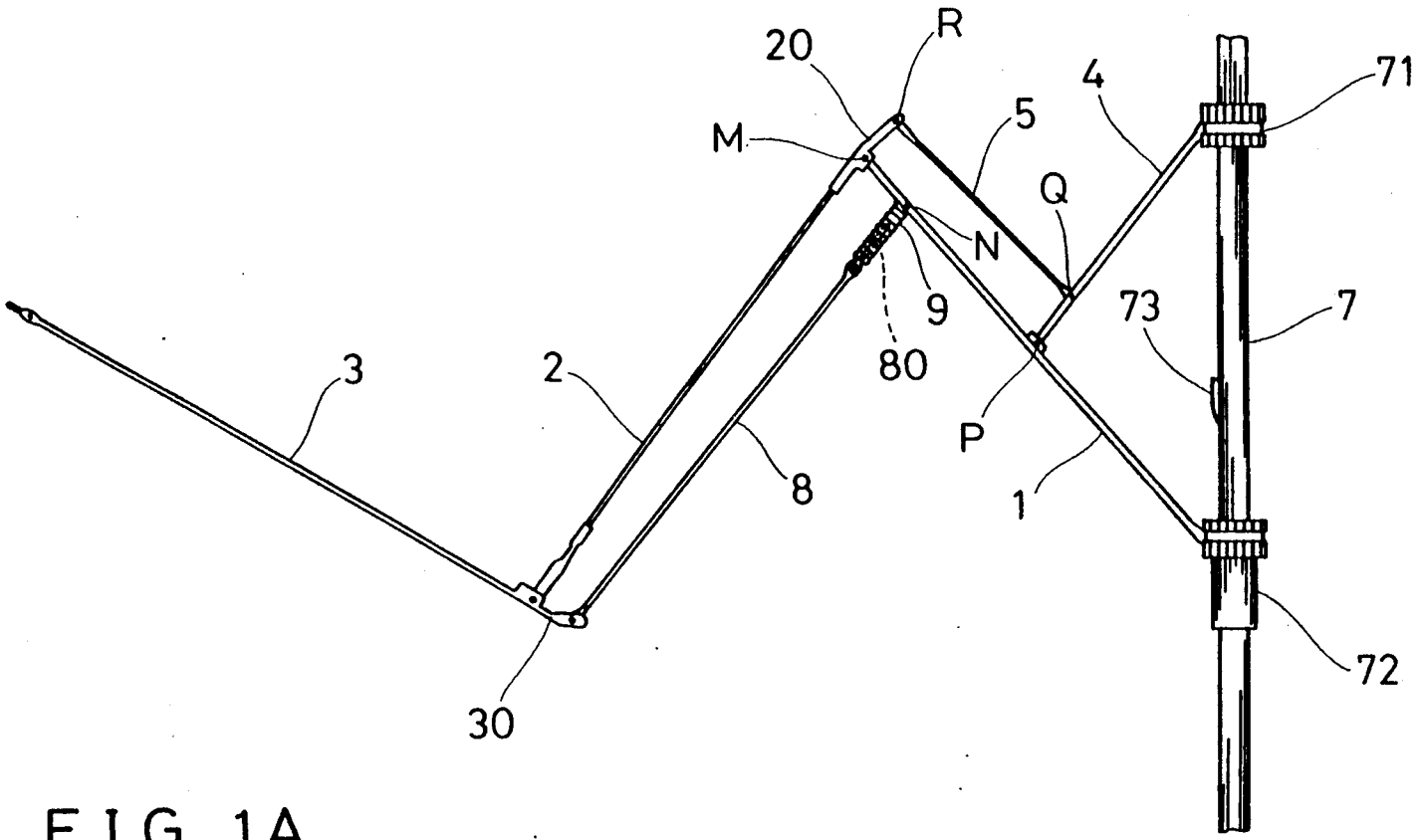
FIG. 1A is a front elevational view of partial structure of a triple-folding umbrella skeleton in accordance with the present invention.
Figure 1B:
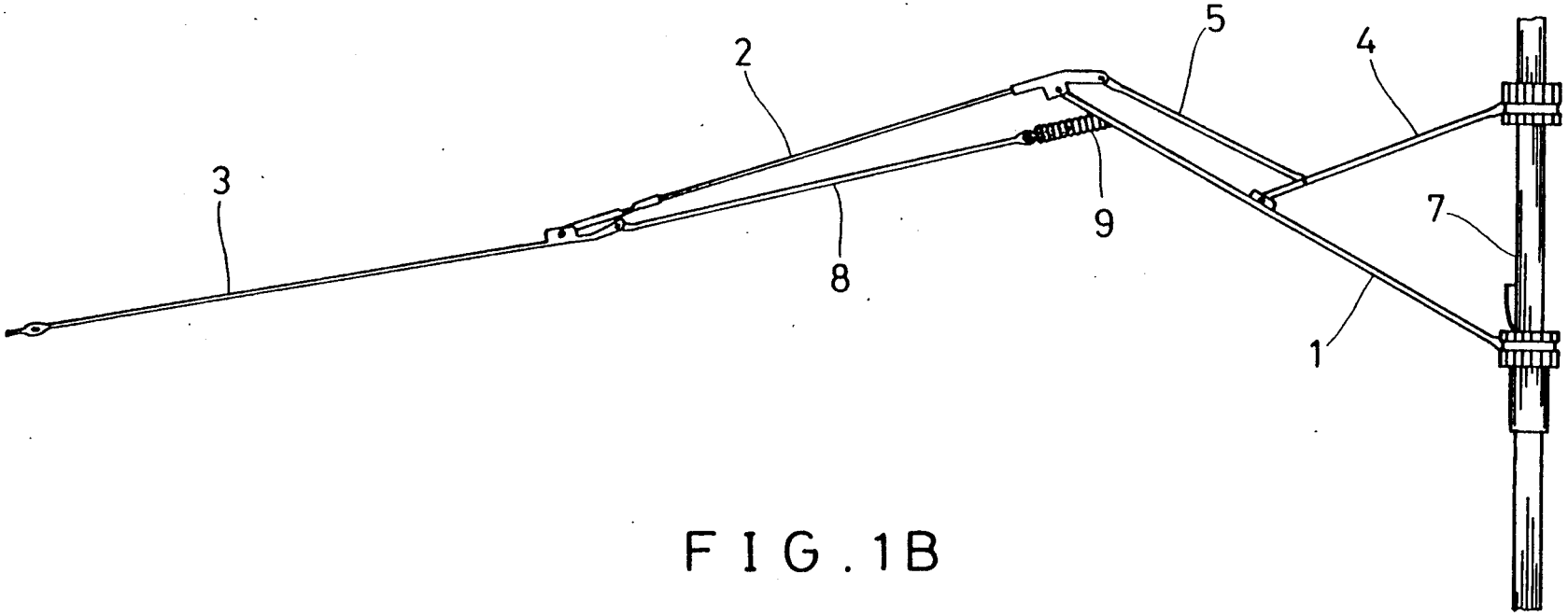
FIG. 1B illustrates that when the umbrella skeleton of FIG. 1A is expanded to a nearly wholly open condition, a connecting spring connected between the second link and the second rib is slightly stretched.
Figure 1C:
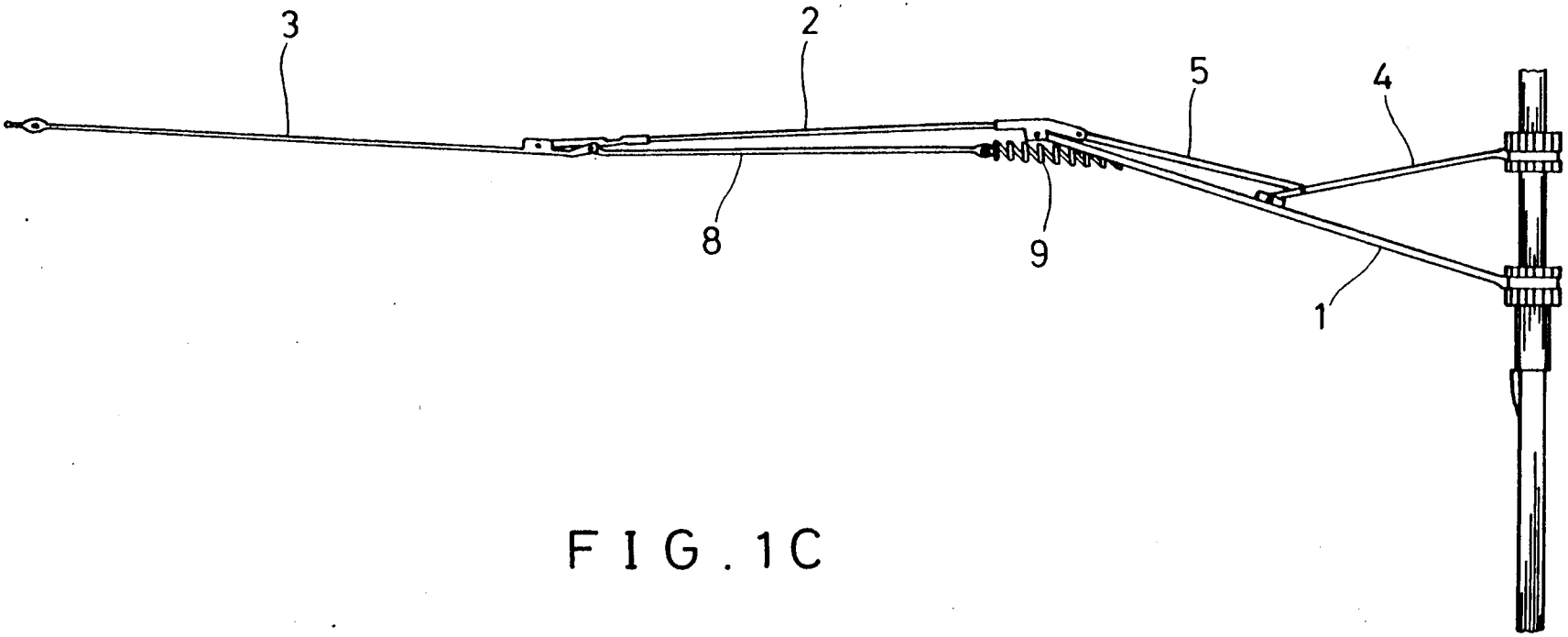
FIG. 1C illustrates that when the umbrella skeleton of FIG. 1B is further expanded to the wholly open condition, the connecting spring connected between the second link and the second rib is stretched in a larger amount.
Figure 2A:
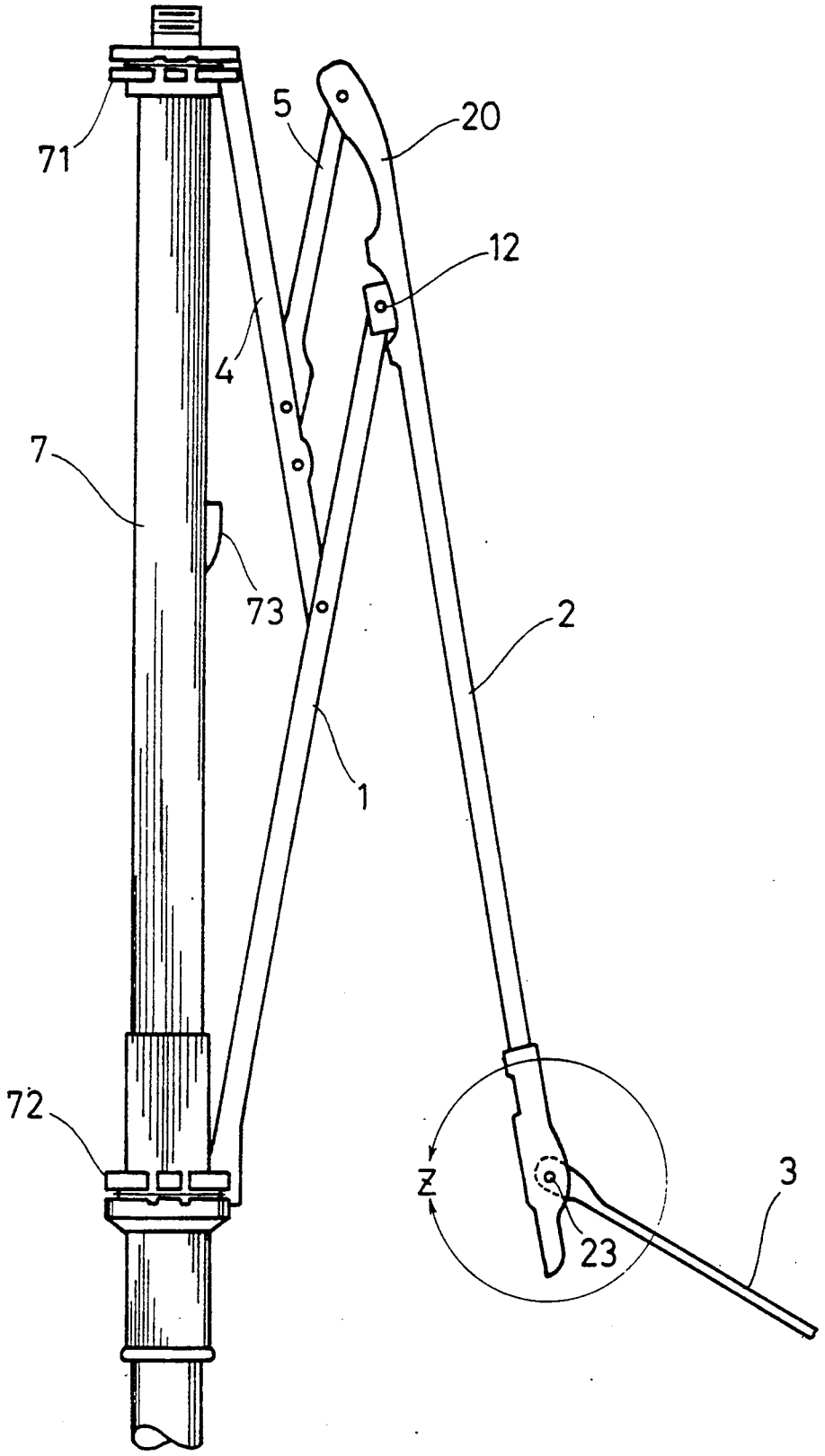
FIG. 2A (PRIOR ART)
FIG. 2A is a front elevational view of partial structure of one conventional triple-folding umbrella skeleton.
Figure 2B:
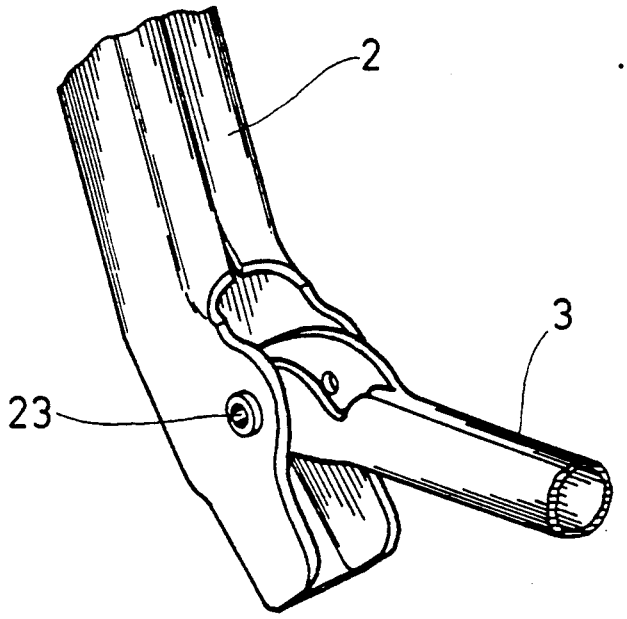
FIG. 2B (PRIOR ART)
FIG. 2B is an enlarged perspective view of the circular area "Z" shown in FIG. 2A.
Figure 2C:
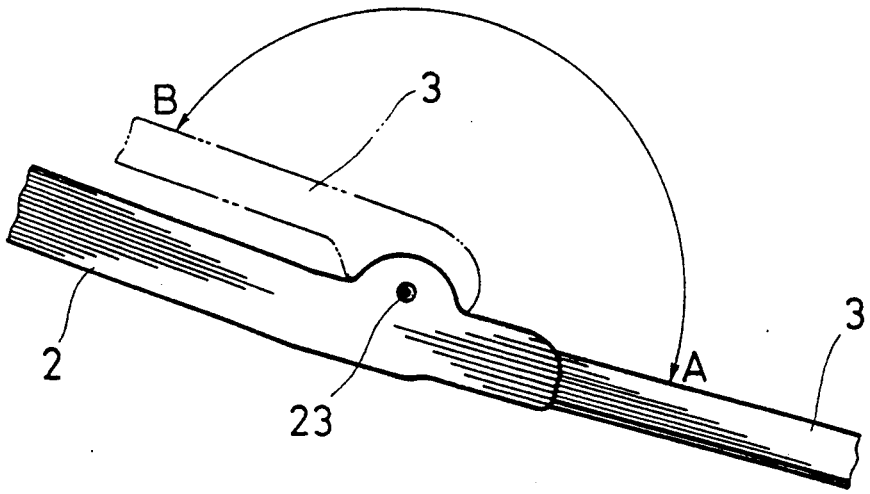
FIG. 2C (PRIOR ART)
FIG. 2C is a side elevational view of the part shown in FIG. 2B.

Referring to FIGS. 1A, 1B, and 1C, the structure and function of the present triple-folding umbrella skeleton will be described clearly hereinafter.

Figure 3A:
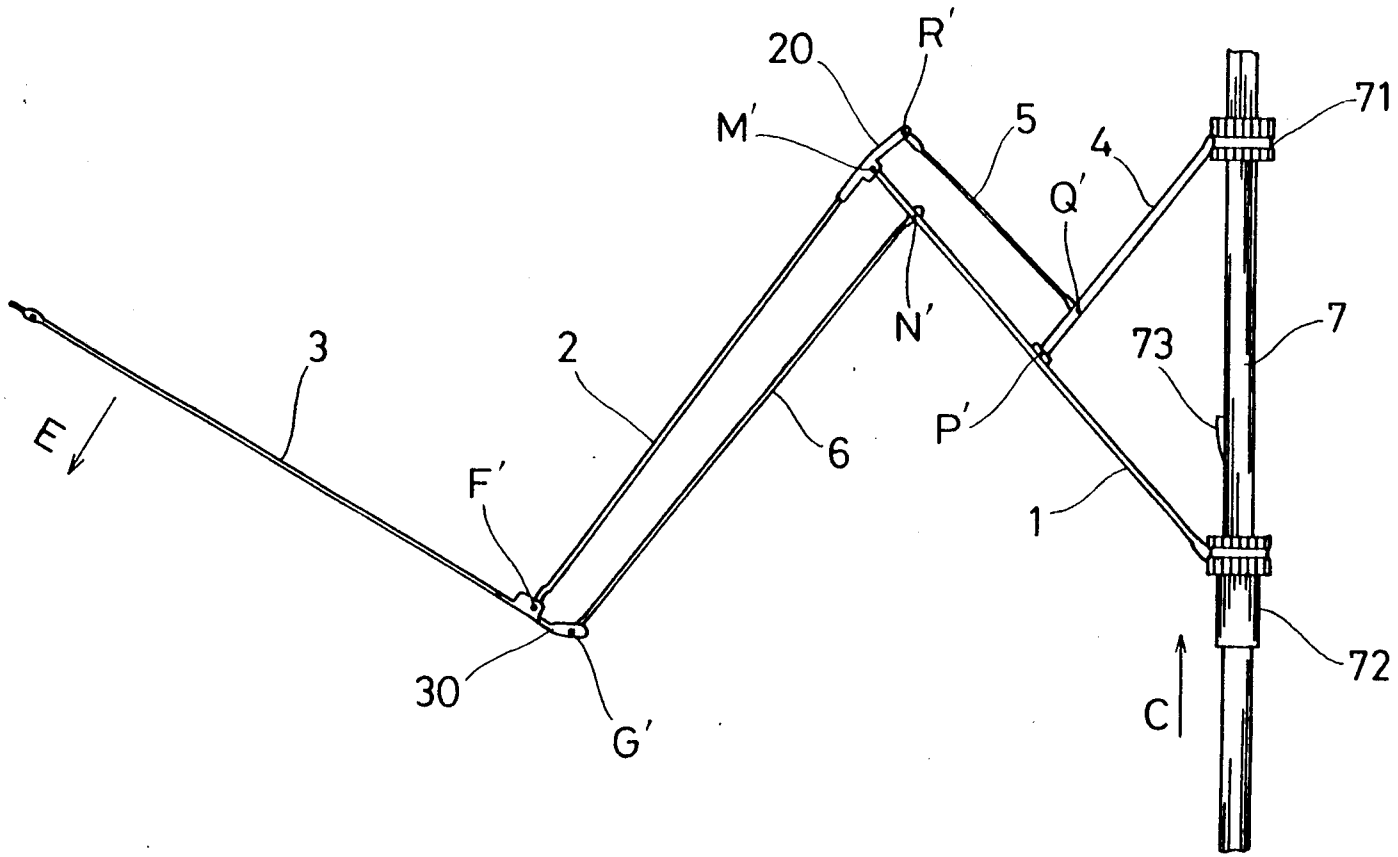
FIG. 3A (PRIOR ART)
FIG. 3A is a front elevational view of partial structure of another conventional triple-folding umbrella skeleton.

In comparison of FIG. 1A and FIG. 3A, it can be found that the present triple-folding umbrella skeleton structure is quite similar to the conventional structure of triple-folding umbrella skeleton shown in FIG. 3A. The only difference is that the second link 8 of the present invention is connected to the first rib 1 via a connecting spring 9 having the form of a coil spring, rather than connected to the first rib 1 directly. One end of the connecting spring 9 is connected to the end portion of the second link 5, and the other end of the connecting spring 9 is pivotably mounted to the first rib 1. The second link 8 has an extension portion 80 extending towards the first rib 1 from the portion at which the connecting spring 9 is connected. The extension portion 80 is inserted into the central hole of the connecting spring 9 in order to prevent sideward deformation of the connecting spring 9.

Figure 3B:
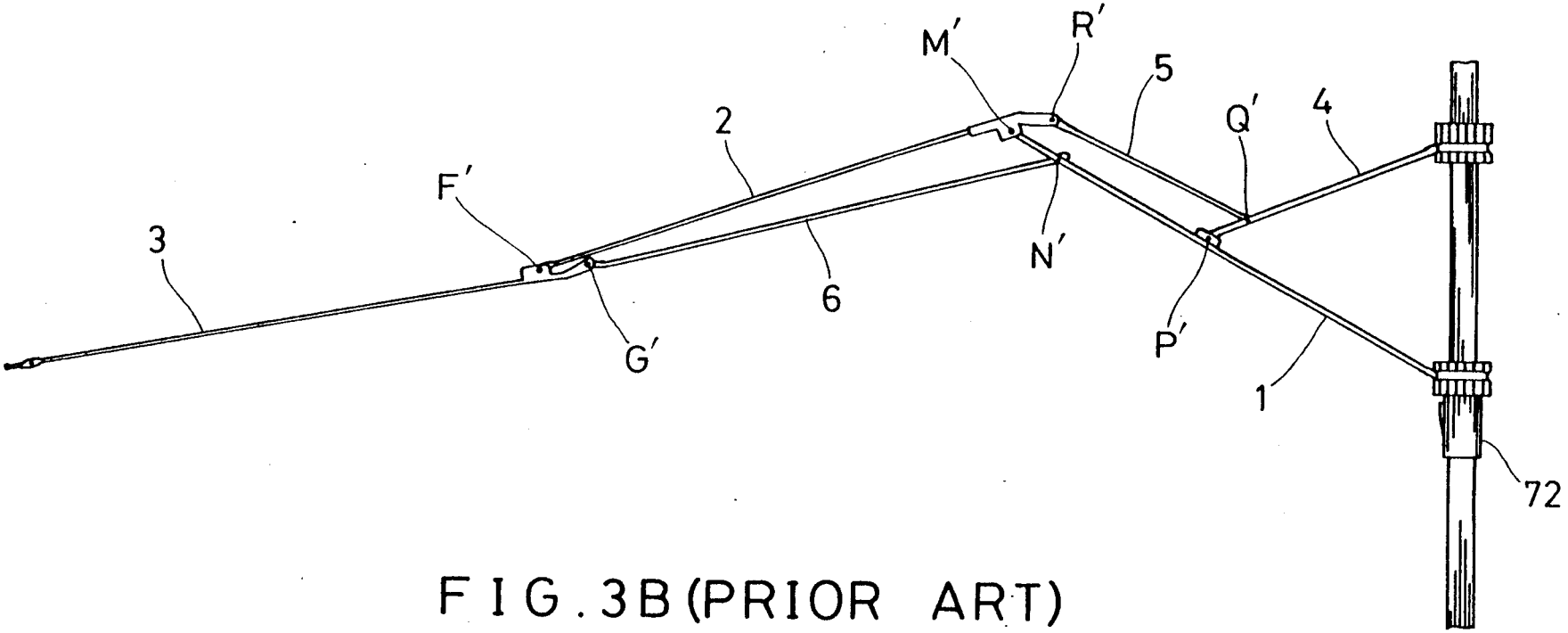
FIG. 3B (PRIOR ART)
FIG. 3B shows the umbrella skeleton of FIG. 3A in a wholly open condition.

FIG. 1B illustrates the state when the umbrella skeleton of the present invention is expanded to a nearly whooly open condition in which the connecting spring 9 is slightly stretched. The condition shown in FIG. 1B is similar to the wholly open condition of the prior umbrella skeleton as shown in FIG. 3B. As described above, when the prior umbrella skeleton is expanded nearly to the condition shown in FIG. 3B, due to the irretractability of the second link 6, the user has to further exert a relatively large force to overcome the deformation resistance generated by the frame sets and, in particular, by the second ribs, for wholly opening the umbrella. On the contrary, the second link 8 of the present inventtion is connected to the first rib 1 via the retractable connecting spring 9. Thus, when the umbrella skeleton is opened to the condition as shown in FIG. 1B, only a relatively small additional force is needed to further push the runner 72 upwards, and thus to further stretch the connecting spring 9 so as to finally expand the umbrella skeleton to the wholly open condition as shown in FIG. 1C, in which the radius measured from the axis of the middle tube 7 to the tip of the third ribs 3 and thus the shielding area of the canopy 3 is increased, as compared with the case of the conventional umbrella shown in FIG. 3B.

Moreover, since a retractable connecting spring 9, instead of a rigid link, is connected to the first rib 1, the free movement and deformation of the parallelogram MPQR is possible. Therefore, shorter ribs and links can be used to form the parallelogram MPQR, implying that all the comprising members of each frame set and the middle tube can be shortened. Accordingly, an umbrella of the present invention in a folded state will be more compact as compared with the above-described prior folding umbrella shown in FIGS. 3A and 3B.

In addition, when suffering wild wind, the third ribs 3 of the present invention can be pivoted upwards without permanent deformation thanks to the possibility of further expansion of the connecting spring 9. However, the third rib 3 of the conventional umbrella skeleton of FIG. 3A will be permanently deformed upon suffering the same wild wind. It is also found in closing the umbrella of the present invention that, due to the spring force by the connecting spring 9, most water drops can be thrown away from the canopy at the very moment when the frame sets begin to retract, thus keeping the user in a desirable drier state. This should be considered as another advantage of the present invention over prior art.

While the invention has been described in terms of what is presently considered to be most practical and preferred embodiment, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A triple-folding umbrella skeleton comprising:

a middle tube;

a notch mounted on the upper portion of said middle tube;

a runner slidably sleeved to the intermediate portion of said middle tube, and capable of being locked to maintain said triple-folding umbrella skeleton in an open condition; and a plurality sets of frame pivotably mounted on said notch and runner respectively, each frame set innclude a first rib, a second rib, a third rib, a stretcher and a first link, each member of said frame set having two ends, one end of said first rib being pivotably mounted on said runner, the two ends of said second rib being pivotably mounted to the other end of said first rib and one end of said third rib resppectively, one end of said stretcher being pivotably mounted on said notch, the other end of said stretcher being pivotably mounted to the approximately intermediate portion of said first rib, said first link being generally parallel to said first rib, said second rib having a first extension portion extending outwards from its end portion at which said first rib is mounted, and the two ends of said first link being pivotably mounted to said first extension portion and said stretcher respectively, so that said first link, said stretcher, said first rib and said first extension portion of said second rib cooperate to form a quadric link structure;

said triple-folded umbrella skeleton being characterized in that:

each frame set further includes a connecting spring and a second link generally parallel to said second rib, said third rib having a second extension portion extending outwards from its end portion at which said second rib is mounted, one end of said second link being pivotably mounted to said second extension portion, and the other end of said second link being connected to said first rib via said connecting spring, whereby each frame set can be expanded to a largest extent to obtain a largest canopy shielding area, and only a smaller force is needed to open said triple-folding umbrella skeleton, due to the retractability of said connecting spring.

* * * * *